United States Patent [19]

Capilla

[11] Patent Number: 4,636,176

[45] Date of Patent: Jan. 13, 1987

[54] BOAT PROPELLED BY A MOTORCYCLE

[75] Inventor: Alejandro Capilla, Adolfo Prieto 725-1, México City, Mexico, 03100

[73] Assignee: Alejandro Capilla, México City, Mexico

[21] Appl. No.: 693,579

[22] Filed: Jan. 22, 1985

[51] Int. Cl.[4] ..... B63H 25/00

[52] U.S. Cl. ..... 441/12; 441/11; 180/198; 180/53.6

[58] Field of Search ..... 440/11, 12; 180/53.6, 180/53.61, 198; 73/117–117.3

[56] References Cited

U.S. PATENT DOCUMENTS

| | | | |
|---|---|---|---|
| 3,709,185 | 1/1973 | Hennel | 440/12 |
| 3,826,216 | 7/1974 | Rhody | 440/12 |
| 3,854,436 | 12/1974 | Cox | 440/12 |
| 3,940,978 | 3/1976 | Akkerman et al. | 73/117 |
| 4,522,601 | 6/1985 | Yoo | 440/12 |

*Primary Examiner*—Galen Barefoot
*Assistant Examiner*—Edwin L. Swinehart

[57] ABSTRACT

A boat propelled by a motorcycle. The boat propelled by a motorcycle has a portable ramp to get the motorcycle on and off. The motorcycle produces rotational energy by its driven wheel and transmits it to a pair of rollers covered by rubber or any nonslippery material. The motorcycle is fastened to the boat by two yokes which support the pedals making them like one piece without movement, except if the whole boat gets moved. Fore roller transmits the driving force to a gear which has a sprocket chain mounted and at the other end of this, has another gear which makes an axis spin that is connected to a gear box. Another shaft extends out of the gear box and makes the propeller spin to move the boat. The gear box has forward propeller direction and reverse propeller direction. The aft roller makes two pulleys spin which make two transmission bands spin and make two more pulleys spin which make two ducted fans spin, one on each side of the engine of the motorcycle and cool it off. The steerable wheel of the motorcycle is supported by a supporting yoke rotatably, so when the steering column moves, a wire that is connected to it will move four pulleys and then the rudder will move too having controllability. The fan protectors have air chest to have control direction for cooling the engine of said motorcycle.

1 Claim, 8 Drawing Figures

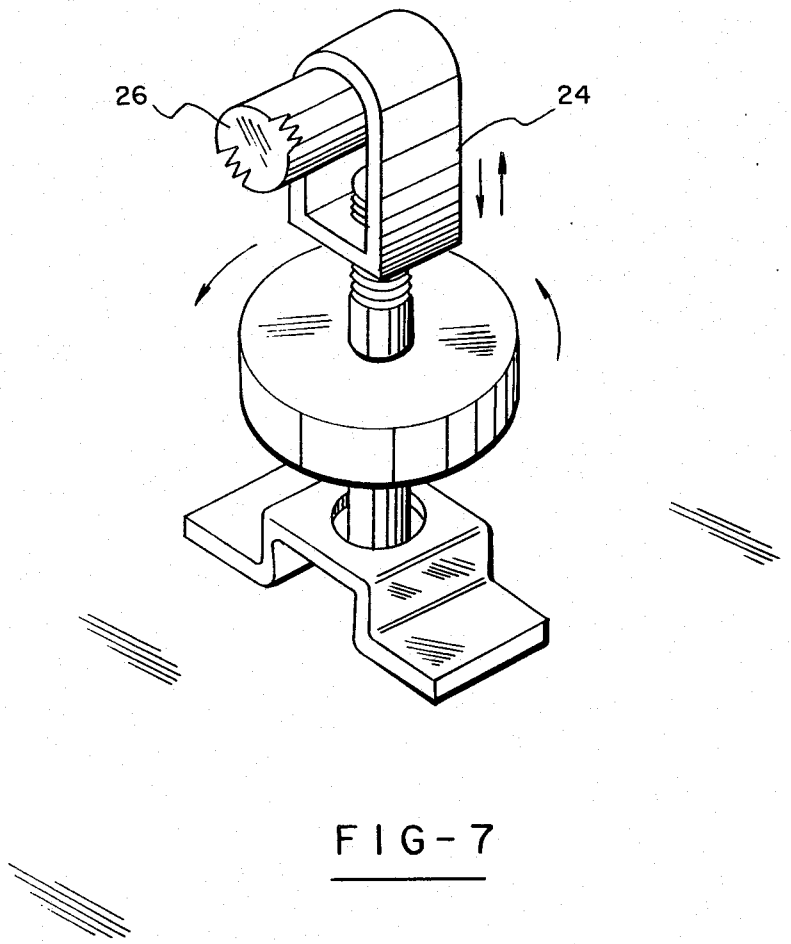
FIG-7
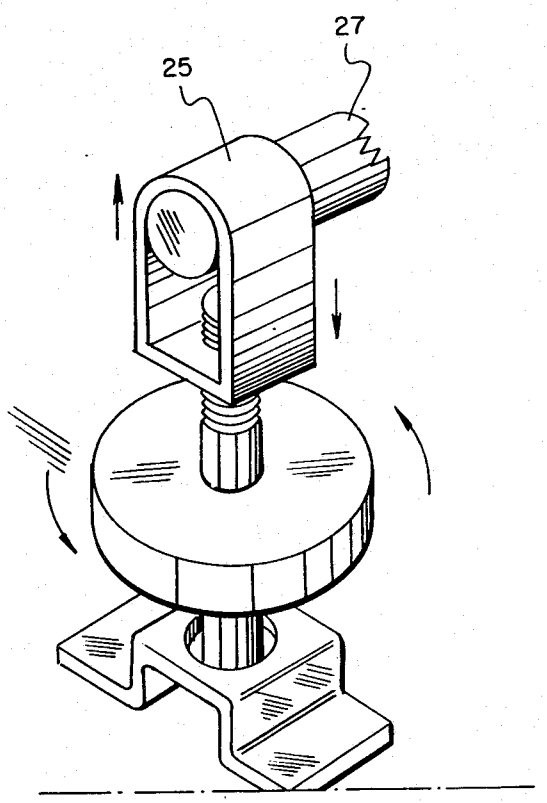

BOAT PROPELLED BY A MOTORCYCLE

OBJECTS OF THE INVENTION

Accordingly several objects of my invention are:

1. Not to need an outboard-motor to propel the boat.
2. To use road-transport (motorcycle) which becomes the driving force to propel the boat.
3. To give a motorcycle more versatility using it as a motor in the boat.

Therefore, some advantages of my invention are: it has cooling for the engine of the motorcycle (it is necessary because the boat moves slower than the motorcycle on the ground), the propeller has reverse direction for an easier control of the boat in the wharf, and to stop easier said boat, it does not need a special design of the boat, the mechanism is simply mounted onto a commercial model of boat, it has one propeller, one shaft of the propeller, one rudder, the yoke system for the motorcycle on the boat is not sophisticated.

Further objects and advantages of my invention will become apparent from a consideration of the drawings and ensuing description thereof.

BRIEF DESCRIPTION OF DRAWINGS

FIG. 7 is a perspective drawing of the yokes which support the pedals of the motorcycle against the hull of the boat.

DESCRIPTION OF THE PREFERRED EMBODIMENT

Figure 1:
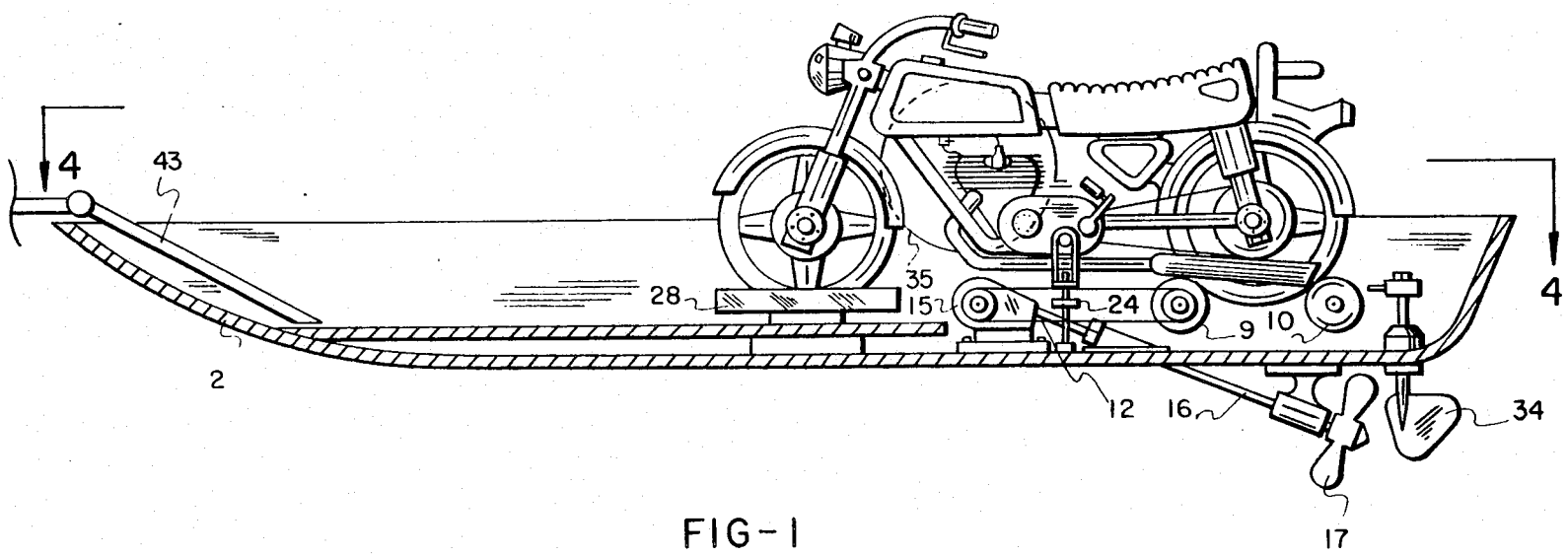
FIG. 1 is a vertical lengthwise cut section of said boat propelled by a motorcycle with all the mechanism mounted.
Figure 2:
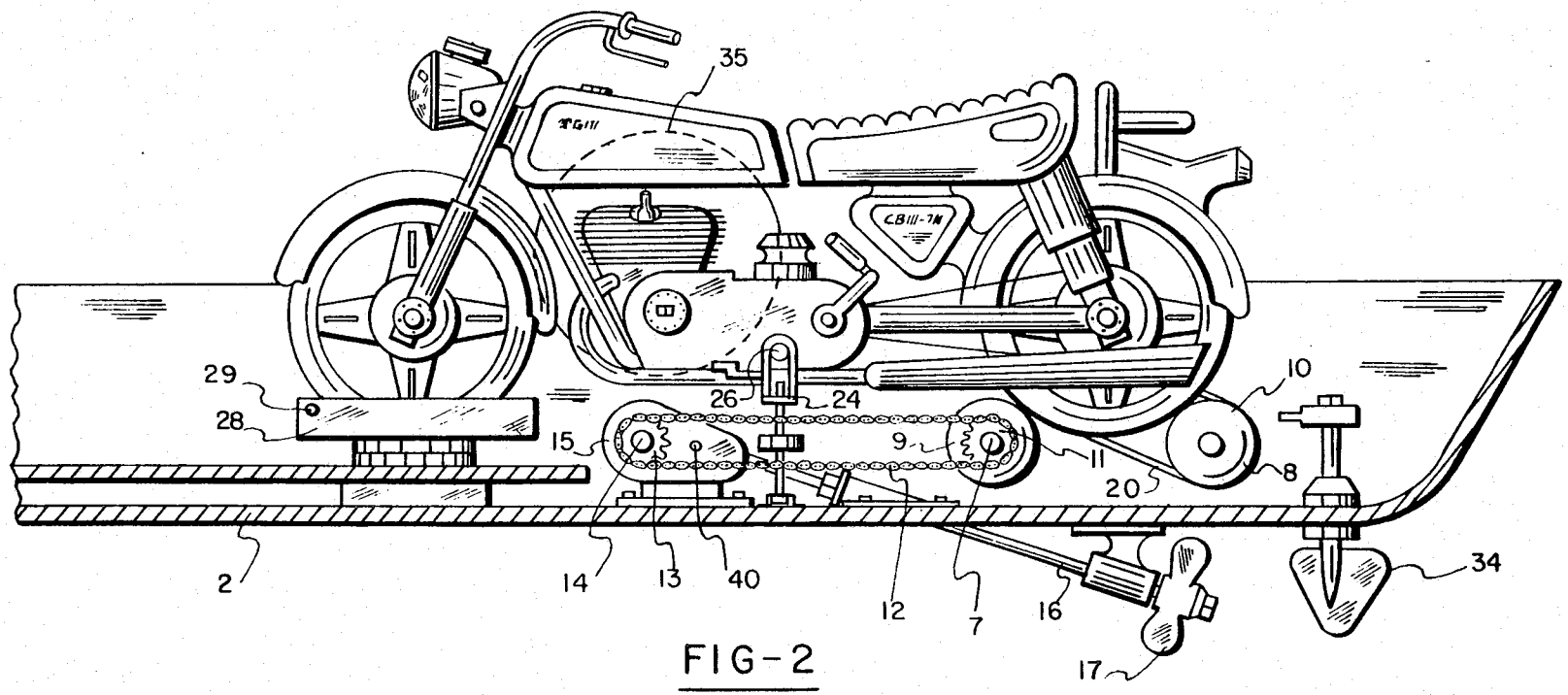
FIG. 2 is a vertical lengthwise cut section of said boat propelled by a motorcycle with all the mechanism mounted.
Figure 3:
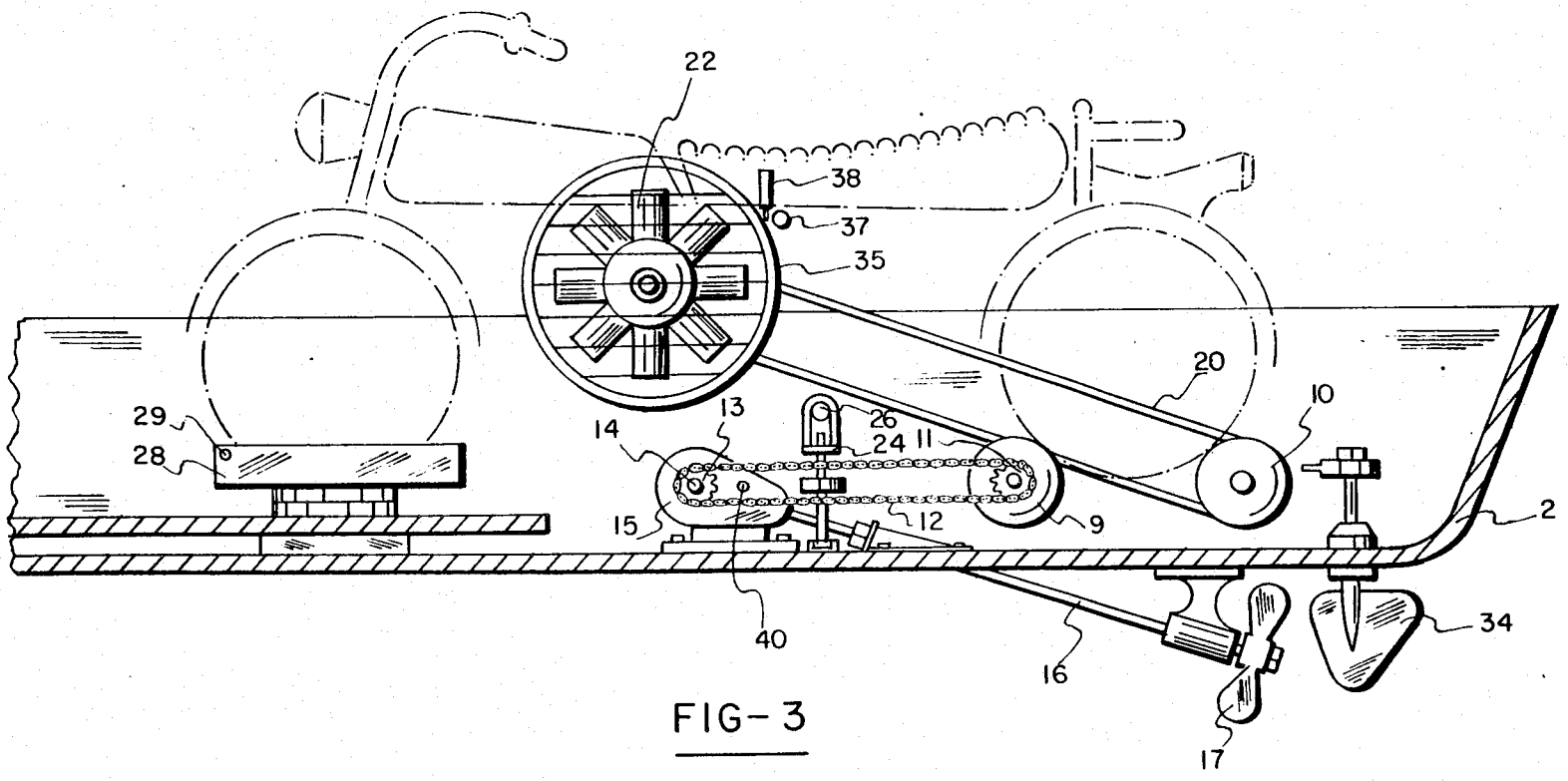
FIG. 3 is a vertical lengthwise cut section of said boat propelled by a motorcycle with all the mechanism mounted without the motorcycle.
Figure 4:
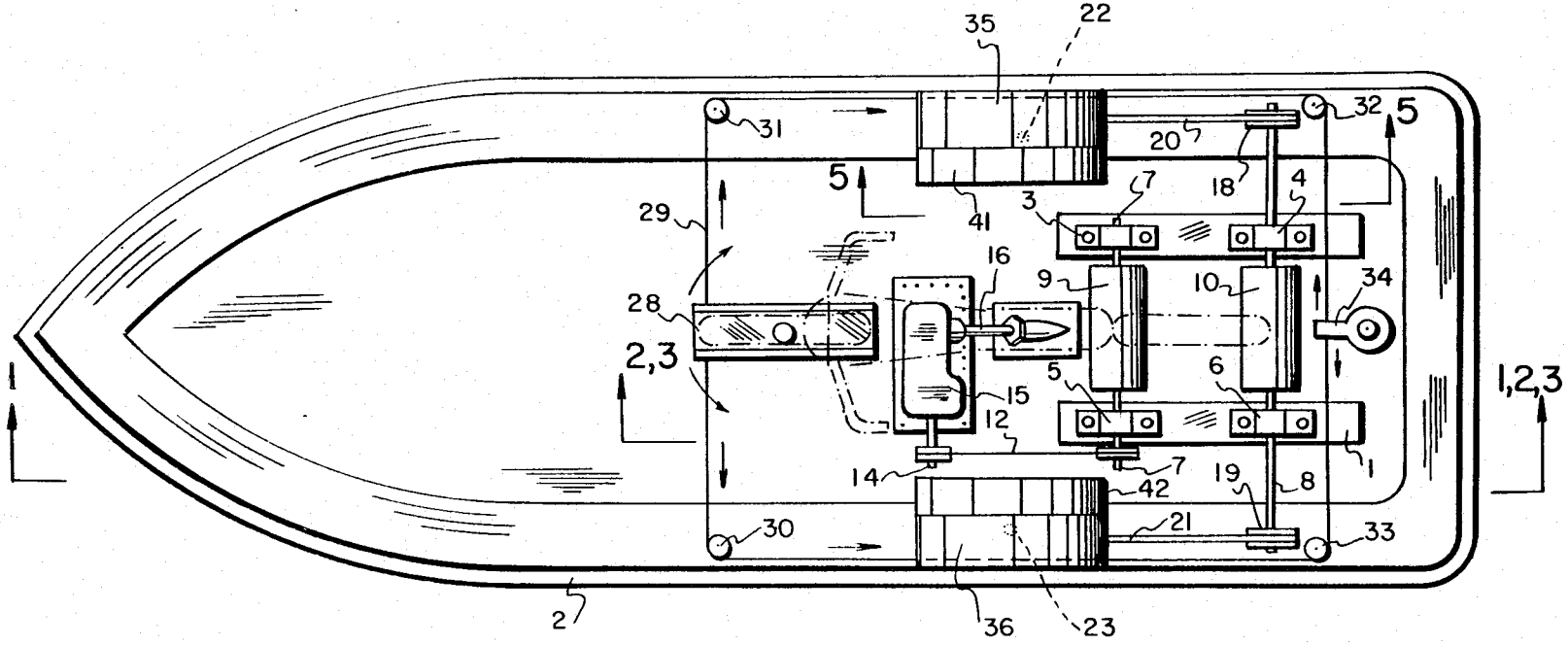
FIG. 4 is a top view of the boat propelled by a motorcycle with all the mechanism mounted without the motorcycle.
Figure 5:
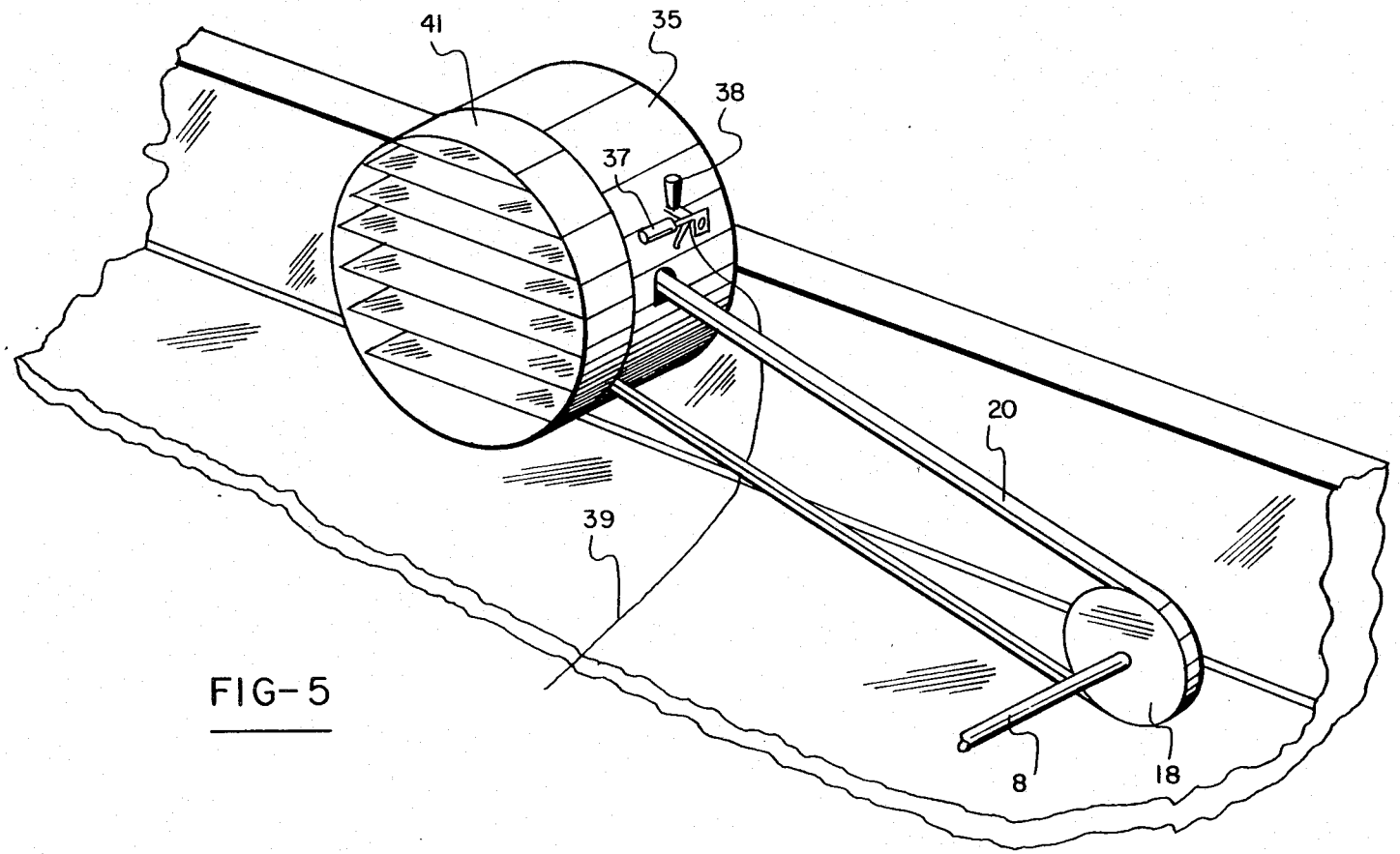
FIG. 5 is a perspective drawing of one fan with its air chest.

The boat propelled by a motorcycle consists of a frame 1 (FIG. 4) which is mounted on the hull 2 (FIGS. 1, 2, 3, 4, 5) and in this frame 1 four bearings are assembled 3, 4, 5 and 6 (FIG. 4) where two axes are contained 7 and 8 (FIGS. 2, 4). Around axes 7 and 8, two rollers are connected, fore 9 and aft 10 (FIGS. 1, 2, 3, 4) covered with rubber or any nonslippery material. Axis 7 and fore roller 9 are connected to a gear 11 (FIGS. 2, 3) that is connected to a sprocket chain 12 (FIGS. 1, 2, 3, 4) and at the other end of the sprocket chain, another gear 13 is connected (FIGS. 2, 3, 4) which is in the middle of an axis 14 (FIGS. 2, 3, 4) and this axis 14 is supported by gear box 15 (FIGS. 1, 2, 3, 4). Gear box 15 has an axis 16 (FIGS. 2, 3, 4) that is connected to the propeller 17 (FIGS. 2, 3, 4). Axis 8 of the aft roller 10 has at each end a pulley 18 and 19 (FIGS. 4, 5) which contain two transmission bands 20 and 21 (FIGS. 4, 5) and they are contained inside the two pulleys which are assembled to a pair of ducted fans 22 and 23 (FIGS. 3, 4). The hull 2 has two yokes 24 and 25 (FIGS. 2, 3, 7) which support the pedals of the motorcycle 26 and 27 (FIGS. 2, 3, 7). The hull 2 has a yoke 28 (FIGS. 1, 2, 3, 4) for the steerable wheel of the motorcycle and is connected to wire 29 (FIGS. 2, 3, 4) and to four pulleys 30, 31, 32 and 33 (FIG. 4). So wire 29 is fastened to the rudder 34 (FIG. 4). The boat has protectors 35 and 36 for the ducted fans 22 and 23 (FIGS. 4, 5). The right protector 35 of the fan 22 has a pair of handles 37 and 38 mounted (FIGS. 5, 6).

Figure 6:
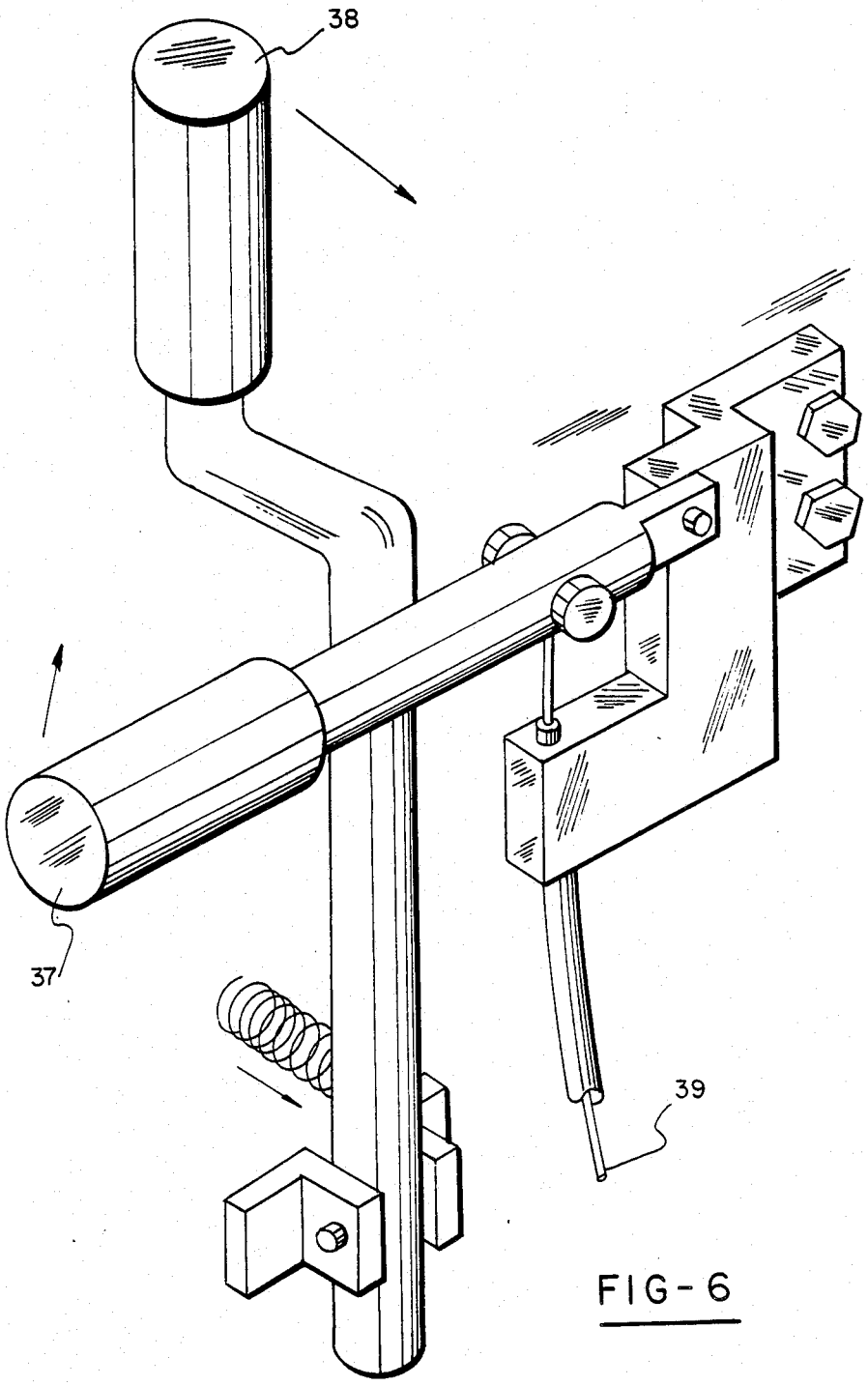
FIG. 6 is a perspective drawing of the two handles to change the direction in the propeller to reverse.
Figure 8:
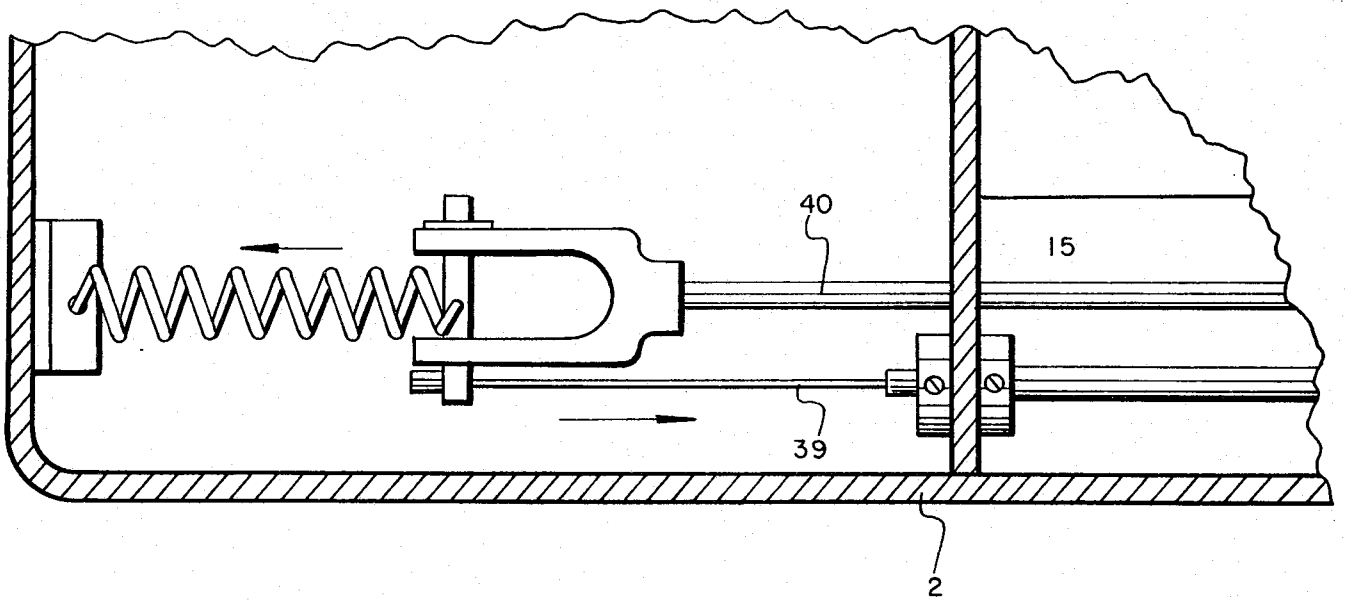
FIG. 8 is a vertical transverse cut section which shows the lever for reversing table movement.

Handle 37 is connected to a pilot wire regulator 39 (FIG. 6). The pilot wire regulator 39 is fastened to a lever for reversing table movement 40 (FIG. 8) that is connected to a gear box 15 (FIG. 8).

The protectors have mounted around them air chests 41 and 42 (FIGS. 4, 5). The boat has a portable ramp 43 (FIG. 1).

All the mechanism has its cover protectors, but in order to have an easier understanding of the invention, these do not appear in the drawings. (gear box protector, pulleys protector, transmission bands protector, etc.)

OPERATION

The boat propelled by a motorcycle works as follows: Take the motorcycle and bring it down onto the boat by the portable ramp 43 (FIG. 1). Put the ramp away in its place, and push the driven wheel of the motorcycle over the two rollers, fore 9 and aft 10 (FIGS. 1, 2). These rollers are covered with rubber (nonslippery material) having good friction. Hold the pedals of the motorcycle by the yokes 24 and 25 (FIGS. 2, 3, 7). The driven wheel of the motorcycle starts to spin and makes the two rollers spin, fore 9 and aft 10 (FIGS. 1, 2, 3, 4), fore roller 9 makes gear 7 spin (FIGS. 2, 3) and the sprocket chain 12 (FIGS. 2, 3, 4). Gear 13 makes the axis 14 spin (FIGS. 2, 3, 4) inside the gear box 15 (FIGS. 1, 2, 3, 4) output shaft 16 will make the propeller spin and enables the boat to sail (FIGS. 1, 2, 3). Aft roller 10 . . . spins with fore roller 9 and makes two pulleys 18 and 19 spin in its axis 8 (FIG. 4).

The pulleys 18 and 19 make the transmission bands 20 and 21 spin (FIGS. 3, 4, 5). The transmission bands 20 and 21 make the two ducted fans 22 and 23 spin that cool off the engine of the motorcycle (FIGS. 3, 4, 5).

Over the protectors of the ducted fans 22 and 23 are mounted air chests which direct the air to the engine of the motorcycle.

To change the direction of the boat to reverse, handle 37 and 38 are used. A spring is tensioning the lever for reversing table movement 40 and having forward propeller direction position (FIG. 8). When handle 37 goes up, wire 39 will move the lever for reversing table movement 40, having reverse propeller direction position, then the handle 38 will maintain this position (FIG. 6), so when handle 38 is pushed forwardly, then the forward propeller direction will engage again (FIG. 6). The steerable wheel of the motorcycle is held by a supporting yoke rotatably 28 (FIGS. 1, 2, 4) which spins with the steering column of the motorcycle, and moves a wire 29 which is supported by four pulleys 30,31,32 and 33 (FIG. 4), the wire 29 moves the rudder 34 controlling the direction of said boat.

Each protector has an air chest 41 and 42 (FIGS. 4, 5) to have better cooling control of the engine of the motorcycle.

While the above description contains many specificities, these should not be construed as limitations on the scope of the invention, but rather as an exemplification of one preferred embodiment thereof. Many other variations are possible, for example: the transmission from the rollers to the gearbox could be done by one shaft and gears instead of sprocket chain, or instead of using transmission bands and pulleys to transmit the force to the fans to cool off the engine of the motorcycle; a sprocket chain could be used, or a generator or an alternator can be connected to an axis and could use electric fans to cool off the engine of the motorcycle.

Accordingly, the scope of the invention should be determined not by the embodiment illustrated, but by the appended claims and theis legal equivalents.

What is claimed is:

1. A boat for use in combination with an engine driven motorcycle having a driven wheel, and a steerable wheel comprising:

a fore roller and an aft roller rotatably mounted on axes which extend transversely of a longitudinal axis of said boat, said rollers being mounted on a frame means which in turn is mounted on the boat, said rollers being in contact with said driven wheel of said motorcycle to transmit the driving force of said wheel to a propulsion means and a cooling means, said propulsion means comprising a gear box means drivingly connected to said fore roller and having an output shaft drivingly connected to a propeller for propelling said boat, said gear box means further comprising shift means for changing the direction of rotation of said output shaft for providing forward and reverse movement of said boat, said shift means comprising a pair of handles mounted to the boat and operably connected to said gearbox, said cooling means comprises a pair or ducted fans drivingly connected to said aft roller and mounted to said boat on respective sides of said motorcycle, and being generally aligned with said engine to effect cooling of said engine, said boat further comprising steering means, said steering means comprising a supporting yoke rotatably mounted to said boat to rotate about a generally vertical axis, said yoke engaging and supporting the steerable wheel of said motorcycle such that the steerable wheel and yoke will rotate together, said yoke being operably connected to a rudder means such that rotation of said steerable wheel and yoke causes rotational movement of said rudder.

* * * * *